US006503107B1

(12) United States Patent
Daoud

(10) Patent No.: US 6,503,107 B1
(45) Date of Patent: Jan. 7, 2003

(54) MODULAR JACK HAVING CONTACTING SPRING LEADS

(75) Inventor: Bassel H. Daoud, Parsippany, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/578,245

(22) Filed: May 24, 2000

(51) Int. Cl.[7] ..... H01R 13/64; H01R 29/00; H01R 3/00

(52) U.S. Cl. ..... 439/676; 439/188; 439/490

(58) Field of Search ..... 439/676, 188, 439/489, 490

(56) References Cited

U.S. PATENT DOCUMENTS

| | | | | | |
|---|---|---|---|---|---|
| 4,165,147 | A | * | 8/1979 | Buck | 439/188 |
| 5,533,907 | A | * | 7/1996 | Kozel et al. | 439/188 |
| 5,639,267 | A | * | 6/1997 | Loudermilk | 439/701 |
| 5,704,797 | A | * | 1/1998 | Meyerhoefer et al. | 200/51.12 |
| 5,839,910 | A | * | 11/1998 | Meller et al. | 439/188 |
| 6,031,909 | A | * | 2/2000 | Daoud | 379/438 |
| 6,073,853 | A | * | 6/2000 | Odic | 235/486 |
| 6,099,333 | A | * | 8/2000 | Daoud et al. | 439/188 |
| 6,106,315 | A | * | 8/2000 | Lalange et al. | 439/188 |
| 6,142,804 | A | * | 11/2000 | Peloza et al. | 439/188 |

* cited by examiner

*Primary Examiner*—P. Austin Bradley
*Assistant Examiner*—Edwin A. León
(74) *Attorney, Agent, or Firm*—Stroock & Stroock & Lavan LLP

(57) ABSTRACT

A modular jack adapted for use in a customer bridge for electrically connecting and disconnecting a customer communications line to a service provider communications line, the modular jack having a first spring lead having a pin portion electrically connected to the service provider communications line and a plug contacting portion contacting a corresponding spring lead on a line plug, and a second spring lead having a pin portion electrically connected to the customer communications line and a plug contacting portion contacting a corresponding spring lead on a line plug, the first and second spring lead plug contacting portions extending in a substantially parallel first direction, the plug contacting portion of the first spring lead having a spring lead contacting portion extending substantially perpendicular to the first direction to resiliently and releasably physically contact the second spring lead plug contacting portion and electrically connect the customer communications line to the service provider communications line when the modular jack is in a normal operating position and to electrically disconnect the customer communications line from the service provider communications line when the modular jack is in a testing position.

12 Claims, 4 Drawing Sheets

MODULAR JACK HAVING CONTACTING SPRING LEADS

FIELD OF THE INVENTION

The present invention relates to a modular jack having contacting spring leads and, more particularly, to a 645-type modular jack including spring leads, at least two of which are constructed so as to make releasable physical contact with each other in the normal operating position.

BACKGROUND OF THE INVENTION

When providing voice and/or data service from a Central Office (CO) to Customer Equipment (CE), a Building Entrance Protector (BEP) or Network Interface Unit (NIU) having a plurality of modular jack housings therein may be provided to serve as the point of demarcation between the CO and CE. These are generally also referred to as customer bridges.

A modular jack housing is typically provided for each communication line from the service provider. A typical modular jack housing includes a modular jack for contacting a corresponding modular line plug. The prior art modular jacks includes spring leads that make contact with corresponding leads on the line plug when the line plug is inserted within the jack housing. In the prior art jacks, each of the spring leads extend in a straight line such that no two of them are constructed or designed to physically contact each other.

In a typical configuration, the communication line from the CO terminates in a 645-type jack. The communication line from the CE on the customer's side of the BEP typically terminates in a RJ11-type line plug. To establish the electrical connection between the jack and the plug, the line plug is inserted into the modular jack housing such that each individual lead on the line plug contacts a corresponding individual spring lead of the jack. Once the spring leads of the jack contact the leads of the plug, the electrical connection between the CO and CE is established. Thus, in the prior art modular jack housings comprising a prior art jack, both a modular jack and line plug are required for establishing the electrical connection between the CO and the CE. It would be desirable to reduce the number of required components to establish the electrical connection so as to provide a simplified system and to reduce manufacturing and service costs.

Equipment (including wiring) located on the customer side of the BEP is the customer's responsibility, while equipment (including wiring) located on the CO side of the BEP is the service provider's responsibility. To diagnose a problem on a particular line from the CO to the CE, the service provider must isolate the wiring on the CO side of the BEP from the wiring on the customer side of the BEP. In the prior art modular jack housings this was accomplished, for example, by removing the line plug from the jack housing and connecting certain testing equipment or a single telephone set. With such a configuration, the process could be both time-consuming and expensive. It would be desirable to provide a simplified system to more easily test the communications system.

The present invention is directed at overcoming shortcomings in the prior art.

SUMMARY OF THE INVENTION

The present invention is directed to a modular jack that comprises at least two spring leads, one of which is constructed to releasably physically contact the other spring lead in the normal operating position. Such a jack could be used in a myriad of wiring or telephony applications requiring switchable contacts, and is especially well suited for use in a customer bridge.

In a preferred embodiment, the present invention is directed to a modular jack comprising four spring leads, two of which are constructed to releasably physically contact the other two spring leads when the jack is in its normal operating position. In a preferred embodiment, the modular jack comprises four spring leads, including two outside leads which are electrically connected to the CE communications line and two inner spring leads which are electrically connected to the CO communications line (which of course may be reversed as a matter of design choice). The two inner spring leads are constructed with J-shaped loops at one end thereof for releasably contacting the other two spring leads when the jack is in its normal operating position (as described below). The inner spring leads are also constructed such that the when the jack is in its testing position (as described below), the inner spring leads do not physically contact the outer spring leads, thus isolating the CO communications line from the CE communications line to accommodate any necessary system testing.

The jack is adapted to be mounted or otherwise installed in a modular jack housing in a manner known in the art. In its normal operating position, the jack is constructed such that the inner spring leads physically contact the outer spring leads, thus establishing an electrical connection between the CO communications line and the CE communications line. Constructed as such, the need for a line plug is obviated thus simplifying the system and reducing manufacturing costs.

The modular jack of the present invention also provides for simplified evaluating or testing the communication system. When installed in a modular jack housing, the jack is positioned so as to enable contact with a modular line plug for performing any necessary testing of the system. To diagnose a problem on a particular line from the CO to the CE, the service provider must isolate the wiring on the CO side of the BEP from the wiring on the customer side of the BEP. In accordance with the present invention, in order to isolate the CO line from the CE line, a user inserts a plug, e.g., an RJ11 type plug, in the modular jack housing. The plug is typically connected to a telephone or other testing device to test the communications line. When the plug is inserted, the resilient spring leads of the jack are moved or urged downwards, in a testing position, such that the loop portion of the inner spring leads no longer physically contacts the outer spring leads. When the physical contact is broken, the CO communications line is isolated from the CE communications line. Once isolated, the technician can perform the necessary testing, e.g., if the technician hears a dial tone in the test equipment he could determine that the CO communication line is operating normally and that therefore the problem must be in the CE communications line. Thus, the modular jack of the present invention provides for simplified evaluating or testing the communication system.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference characters denote similar elements throughout the several views.

DETAILED DESCRIPTION OF THE PRESENTLY PREFERRED EMBODIMENTS

Figure 1:
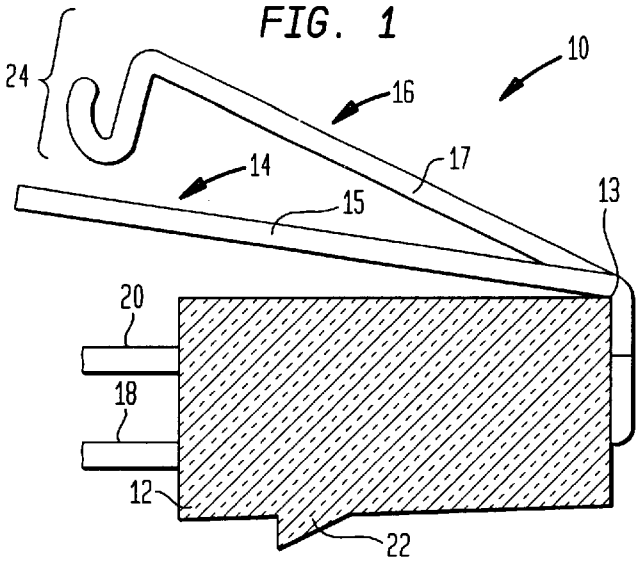
FIG. 1 is a side elevational cutaway view of a modular jack constructed in accordance with the present invention.

The present invention is directed to a modular jack that comprises at least two spring leads, one of which is constructed to releasably and physically contact the other spring lead in the normal operating position. As used herein, the term modular jack comprises any Ape of modular jack regardless of the size of the modular jack, and includes by way of non-limiting example, 645, RJ11, and RJ45-type modular jacks and other art-recognized modular jacks for use in connecting telephony equipment to a communications or network line, or other electrical or electronic applications.

Referring now to the drawings in detail, a modular jack 10 constructed in accordance with the present invention is depicted in FIGS. 1–6. The jack 10 may be provided as part of a modular jack housing or customer bridge (see, e.g., FIG. 7) which is mounted in a building entrance protector (BEP) or NIU 60 (see, e.g., FIG. 11) or at virtually any point in a communications network (voice, data, voice/data, etc.) 100 (see, e.g., FIG. 11) in which a modular jack housing is provided. Thus, the detailed description provided herein, which is directed primarily to a communication link between a service provider (i.e., a Central Office (CO)) and a customer (i.e., Customer Equipment (CE)) is provided as an illustrative, non-limiting example.

Figure 2:
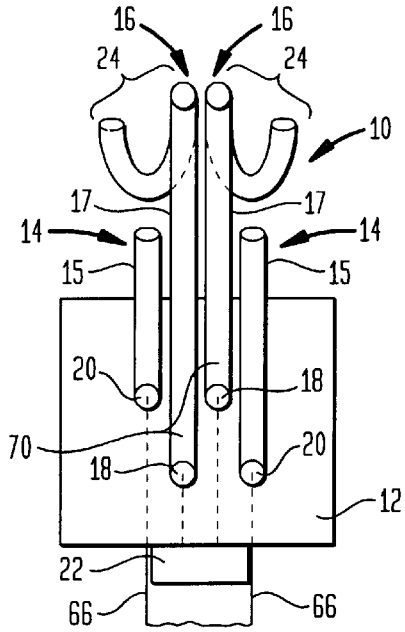
FIG. 2 is a front elevational view of the modular jack of FIG. 1.
Figure 3:
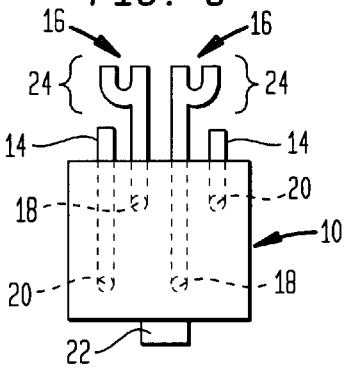
FIG. 3 is a rear elevational view of the modular jack of FIG. 1.

As seen in FIGS. 1–3, the modular jack of the present invention, generally indicated as 10, comprises inner spring leads, generally indicated as 16, and outer spring leads, generally indicated as 14. Spring leads 14 are preferably constructed of an electrically conductive resilient material of a type known in the art for use in forming electrical contacts of the type shown and described herein. Spring leads 14 generally have pin portions 20, and spring leads 16 generally have pin portions 18, for making an electrical connection between the spring leads and CO communications line 70 (FIG. 11) and CE communications line 66 (FIG. 11) in a manner known in the art. The spring leads generally comprise pin portions 18 and 20 which extend horizontally through the jack body 12 and are then bent generally 90 degrees upwards towards a top corner 13 of jack body 12, and then angled obliquely from top corner 13 back towards pin portion 18 and 20 (i.e., towards the rear of jack 10).

As seen in FIGS. 1–6, outer spring leads 14 comprise a plug contacting portion 15 for contacting a corresponding lead 36 on plug 34 (FIG. 9) for testing the system (as described below). Inner spring leads 16 comprise a plug contacting portion 17 for contacting a corresponding lead 36 on plug 34 (FIG. 9) for testing the system (as described below), and also comprise a spring lead contacting portion 24 for releasably physically contacting outer spring 14 (as described below). Insert body 12 comprises, by way of a non-limiting example, a latch tab 22 which is adapted to maintain modular jack 10 within a modular jack housing 30 in a manner known in the art as seen in FIG. 7.

As seen in FIG. 1, the oblique angle between the vertical portion and the plug contacting portion 17 of the inner spring lead 16 is greater than the oblique angle between the vertical portion and the plug contacting portion 15 of the outer spring lead 14. This greater angle provides for biasing the spring lead contacting portion 24 against the plug contacting portion 15 of the outer spring lead 14 when jack 10 is in its normal operating position (FIG. 4).

Figure 4:
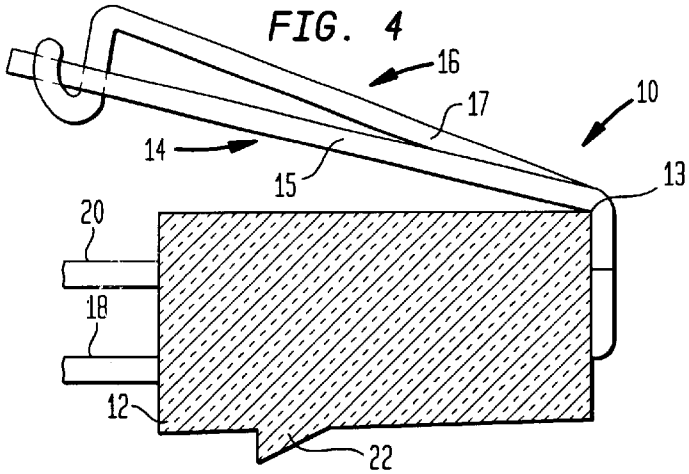
FIG. 4 is a side elevational cutaway view of the modular jack of FIG. 1 with the spring leads in their normal operating position.
Figure 5:
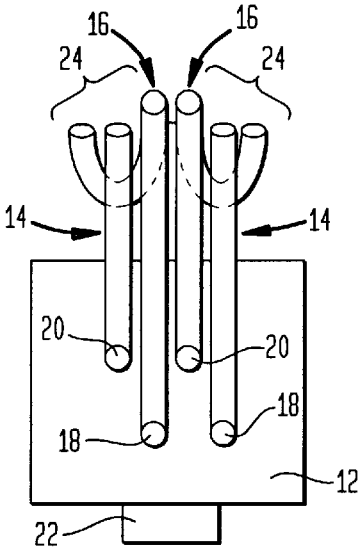
FIG. 5 is a front elevational view of the modular jack of FIG. 4.
Figure 6:
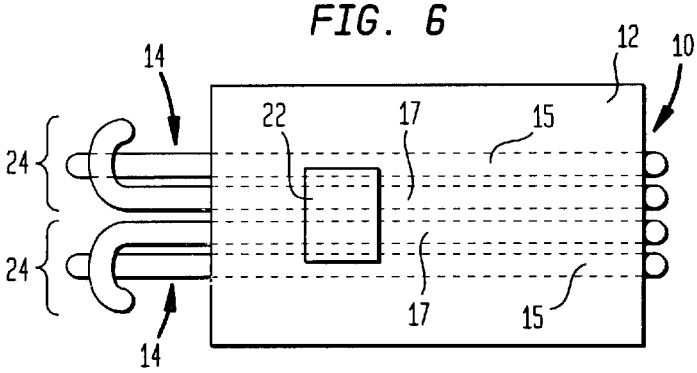
FIG. 6 is a bottom plan view of the modular jack of FIG. 4.

As seen in FIGS. 4–6, which depict the modular jack 10 in its normal operating position, inner spring leads 16 are constructed and positioned such that spring lead contacting portion 24 is in physical contact with plug contacting portion 15 of outer spring lead 14. Thus, in its normal operating position, outer spring lead 16 is in physical contact with inner spring lead 14. While spring lead contacting portion 24 is generally depicted as a J-shaped portion, one of skill in the art, upon reading the subject specification, will understand that the actual shape of the spring lead contacting portion is not critical so long as the shape of the spring lead contacting portion is capable of carrying out the functions described herein. Thus, other shapes and configurations are envisioned without departing from the spirit of the invention, e.g., L-shaped, V-shaped, U-shaped, spade-shaped, etc. In any event, as seen in FIGS. 4–6, when the modular jack of the present invention is in its normal operating position, inner spring leads 16 physically contact outer spring leads 14. Further, as described below, such contact is releasable for testing a communications system utilizing the modular jack of the present invention.

Figure 7:
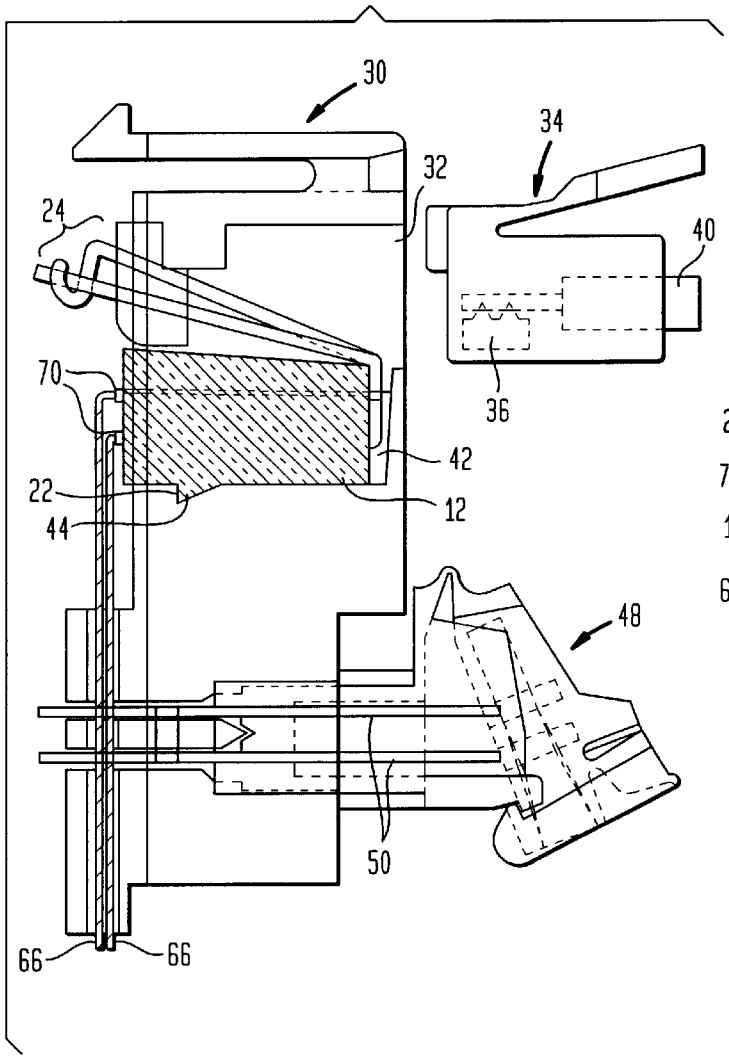
FIG. 7 is a side elevational cutaway view of the modular jack of FIG. 4 inserted within a modular jack housing, with the spring leads in their normal operating position.

As seen in FIG. 7, the modular jack 10 of the present invention is adapted to be installed or otherwise mounted in a modular jack housing, generally indicated as 30. The modular jack housing 30 comprises a plug receiving space 32 for accepting a line plug 34 in a manner known in the art. Housing 30 also comprises jack receiving space 42 to accept modular jack insert 10 in a manner known in the art, e.g., latch tab 22 of the jack insert 10 cooperates with a latch tab receiving space 44 in the jack housing 30 to maintain or otherwise mount the jack insert 10 within the housing 30. The housing 30 may also comprise an Insulation Displacement Connector (IDC), generally indicated as 48, for performing testing or otherwise connecting external devices to communications line 66. IDC 48 may comprise terminal strips 50 which extend into the housing 30 to make an electrical connection with communication line 66 in a manner known in the art. The modular jack housing may form a customer bridge.

Figure 8:
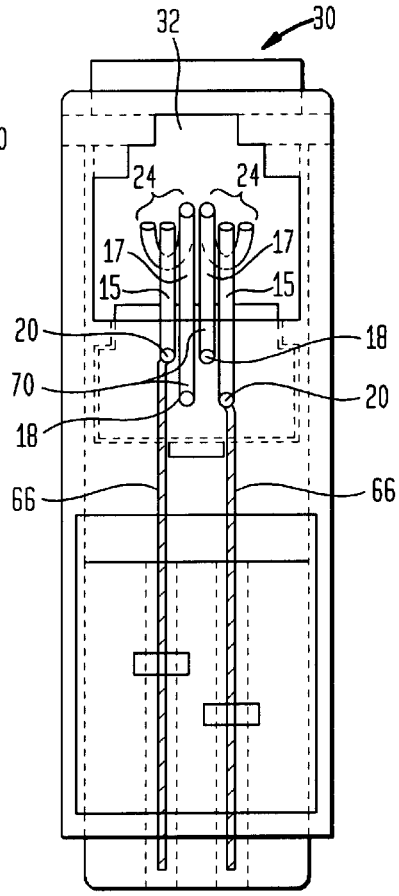
FIG. 8 is a front elevational view of the modular jack housing of FIG. 7.

As seen in FIGS. 7 and 8, the CE communication line 66 enters modular jack housing 30 and is electrically connected to pin portions 20 of the outer spring leads 14. Such an electrical connection is provided in a manner known in the art. Similarly, pin portions 18 of the inner spring leads 16 are connected to the CO communication line 70 in a manner known in the art. Thus, as one of skill in the art will understand upon reading the subject specification, when the modular jack 10 of the present invention is in its normal operating position an electrical connection is established between the CE communications line 66 (FIG. 11) and the CO communications line 70 (FIG. 11) without having to have a line plug 34 installed within plug receiving space 32 of modular jack housing 30. That is, the physical contact between the spring leads 14 and 16 obviates the need for a line plug 34, thus simplifying the system and reducing manufacturing and servicing costs.

Figure 9:
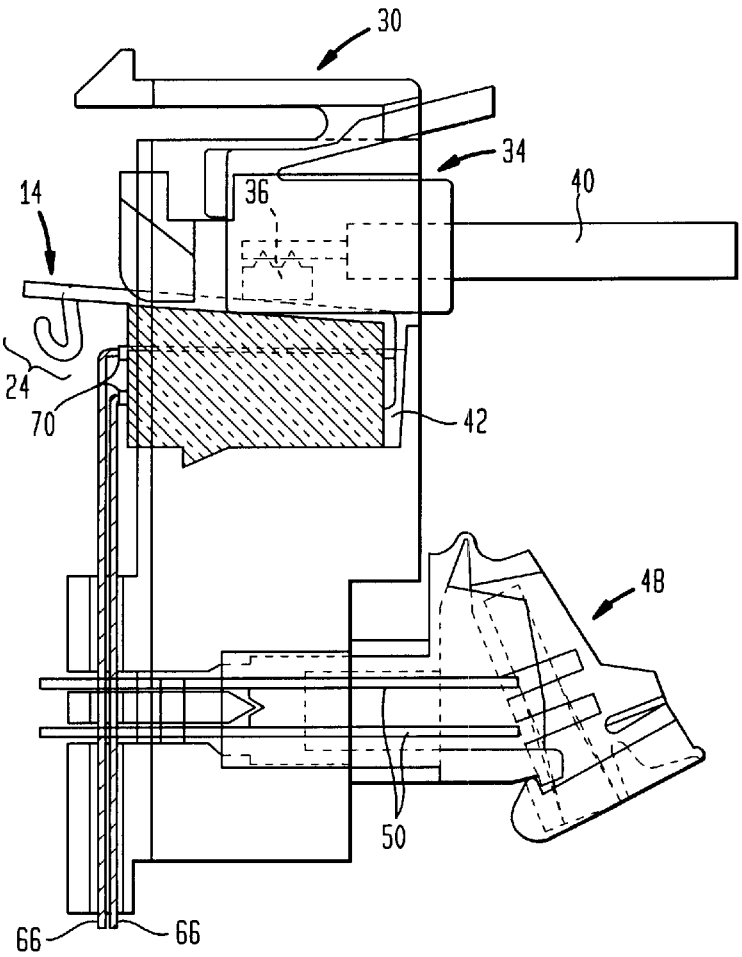
FIG. 9 is a side elevational cutaway view of the modular jack of FIG. 4 inserted within a modular jack housing, and with a plug inserted within the modular jack housing, the plug forcing the spring leads into their testing position such that no spring lead physically contacts another spring lead.
Figure 10:
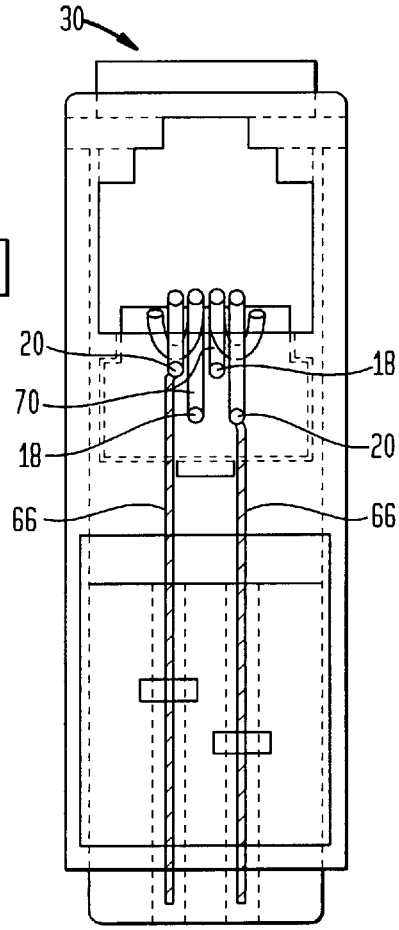
FIG. 10 is a front elevational view of the modular jack housing of FIG. 9.

In order to test the communication system 100 (FIG. 11), it is often necessary to isolate the CO communication line 70 from the CE communication line 66. As seen in FIGS. 9 and 10, this may be accomplished by inserting a plug 34 into plug receiving space 32 of modular jack housing 30. When plug 34 is inserted into plug receiving space 32, the leads 36 on plug 34 force both the outer spring leads 14 and inner spring leads 16 of the modular jack 10 downward (i.e., reducing the oblique angle between their respective vertical portions and their plug contacting portions). Once plug 34 is installed within plug spacing receiving 32, spring lead contacting portion 24 of inner spring leads 16 are no longer maintained in physical contact with outer spring leads 14. Such a position with respect to the modular jack 10 of the present invention is referred to herein as a testing position.

Plug 34, as is known in the art, typically comprises four leads 36 for electrically contacting the corresponding spring leads of the modular jack. The plug leads are in turn connected to a wire 40 which is connected to a testing device (not shown) such as a telephone. As one of skill in the art will recognize upon reading the subject specification, when plug 34 is fully inserted within plug receiving space 32, the CO communication line 70 is isolated from the CE communication line 66, thus enabling the testing of the communication system. That is, when the plug 34 is fully inserted, the outer spring leads 14 no longer contact the inner spring leads 16 and, thus, the testing equipment or telephone set (not shown) is directly connected to the CO communication line 70, thus bypassing the CE communication line 66. If the technician receives a dial tone, for example, on the testing equipment, he can determine that any problem in the system must be located at the CE communication line 66 side of the BEP 60. Of course, additional testing is also available via IDC 48, in a manner known in the art. Once the testing is accomplished, plug 34 is then removed from plug receiving space 32, returning the spring leads of the modular jack 10 to their normal operating position. Thus, as described above, in order to isolate the CO communication line 70 from the CE communication line 66, a technician need only insert plug 34 within plug receiving space 32. To test the system, a telephone (not shown) is connected to wire 40 of plug 34. If no dial tone was detected upon inserting plug 34, then the technician would recognize that the problem existed in the CO communication line 70, and not the CE communication line 66. Thus, the modular jack 10, constructed in accordance with the present invention, provides for quick, easy and cost-efficient testing of a communication system.

Figure 11:
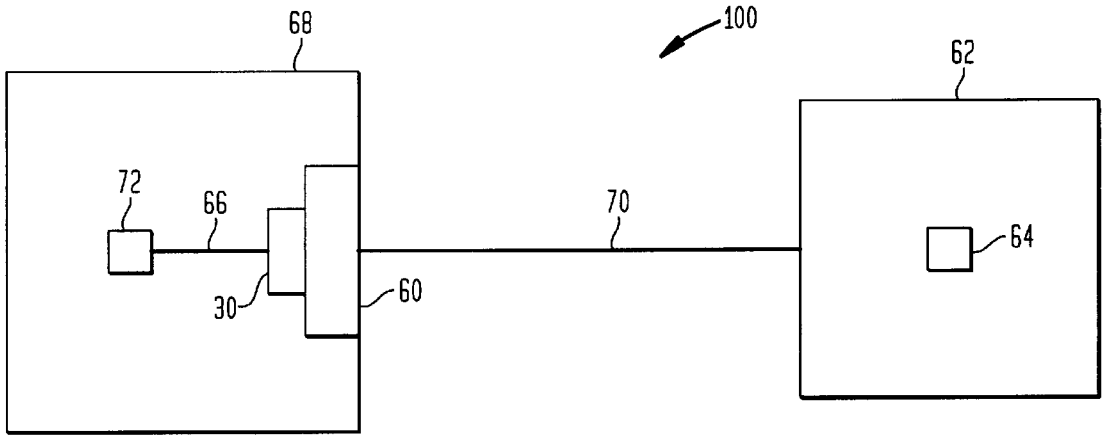
FIG. 11 is a schematic view of a communications network including a Central Office communications line and Customer Equipment communications line having a Building Entrance Protector equipped therebetween, the BEP having a modular jack housing therein, the modular jack housing having a modular jack constructed in accordance with the present invention therein.

Referring next to FIG. 11, a communications network 100 is schematically depicted and includes a central office (CO) 62 having installed therein communications equipment 64 that may include, by way of non-limiting example, a voice switch, a data switch, test/diagnostic equipment, computers, and various other electronic hardware and software devices and systems generally known in the art. A CO communication line 70 extends from the CO 62 to a customer location 68 that includes a building entrance protector (BEP) 60 having a modular jack housing 30 having therein a modular jack 10 constructed in accordance with the present invention. The modular jack 10 is connected between the CO communication line 70 and the CE communications line 66 which extends from the BEP 60 to the customer equipment 72.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A customer bridge for electrically connecting and disconnecting a customer communications line to a service provider communications line comprising:

a modular jack receiving space for receiving a modular jack and a line plug receiving space for receiving a line plug;

said modular jack comprising a first spring lead, a second spring lead, a third spring lead and a fourth spring lead, said first spring lead comprising a contacting portion releasably and physically contacting said second spring lead when said jack is in a normal operating position, and said third spring lead comprising a contacting portion releasably and physically contacting said fourth spring lead when said jack is in a normal operating position;

said first and said third spring leads being electrically connected to said service provider communications line, and said second and said fourth spring leads being electrically connected to said customer communications line;

said customer communications line and said service provider communications line being electrically connected by said first, second, third and fourth spring leads when said modular jack is in said normal operating position;

said first spring lead contacting portion being moved out of contact with said second spring lead and said third spring lead contacting portion being moved out of contact with said fourth spring lead when said line plug is inserted within said line plug receiving space electrically isolating said customer communications line from said service provider communications line.

2. The customer bridge of claim 1, wherein said first and said third spring lead contacting portions are generally J-shaped, L-shaped, U-shaped, or spade-shaped.

3. The customer bridge of claim 1, wherein said line plug is an RJ11-type plug;

4. A modular jack for use in a customer bridge and electrically connecting and disconnecting a customer communications line to a service provider communications line;

said modular jack comprising a first and third spring lead each having a pin portion electrically connected to said service provider communications line and each having a plug contacting portion for contacting a corresponding spring lead on a line plug, and a second and fourth spring lead each having a pin portion electrically connected to said customer communications line and each having a plug contacting portion for contacting a corresponding spring lead on a line plug, said first, second, third and fourth spring lead plug contacting portions extending in a substantially parallel first direction;

said plug contacting portion of said first and third spring leads each having a J-shaped spring lead contacting portion extending substantially perpendicular to said first direction to resiliently and releasably physically contact said second and fourth spring lead plug contacting portions, respectively, and electrically connect said customer communications line to said service provider communications line when said modular jack is in a normal operating position and to electrically disconnect said customer communications line from said service provider communications line when said modular jack is in a testing position.

5. The modular jack of claim 4, wherein said jack is installed in said customer bridge.

6. The modular jack of claim 4, wherein said customer bridge is adapted to accept said line plug.

7. The modular jack of claim 6, wherein said line plug is adapted to bias said modular jack to said testing position when inserted within said customer bridge.

8. The customer bridge of claim 4, wherein said line plug is an RJ11-type plug.

9. A modular jack comprising a jack body and two electrically conductive resilient inner spring leads and two electrically conductive resilient outer spring leads each extending through said jack body;

said jack body comprising a left side wall surface, a right side wall surface and a top wall surface;

said inner and outer spring leads each comprising a pin portion extending in a generally horizontal direction through said jack body from said left side wall surface of said jack body to a lower corner portion proximate said right side wall surface, a vertical portion extending from said lower corner portion in a direction about 90 degrees upwards to a top corner portion proximate a top corner of said jack body, and an obliquely angled portion extending from said vertical portion at an oblique angle from said top corner portion towards said left side wall surface of said jack body, said obliquely angled portions of said inner spring leads each comprising a generally J-shaped spring lead contacting portion releasably and physically contacting said obliquely angled portions of said outer spring leads;

wherein the oblique angle between said vertical portion and the obliquely angled portion of said inner spring leads is greater than the oblique angle between the vertical portion and the obliquely angled portion of said outer spring leads, thereby biasing said generally J-shaped spring lead contacting portions against said obliquely angled portions of said outer spring leads when modular jack is in a normal operating position.

10. The modular jack of claim 9, wherein said jack body comprises a latch tab which is adapted to maintain said modular jack within a modular jack housing.

11. The modular jack of claim 9, wherein said inner spring lead pin portions are electrically coupled to a service provider communications line and said outer spring lead pin portions are electrically coupled to a customer communications line.

12. The modular jack of claim 11, wherein said modular jack forms part of a customer bridge for electrically connecting and disconnecting said customer communications line to said service provider communications line.

* * * * *